United States Patent [19]

Williams

[11] Patent Number: 4,678,201

[45] Date of Patent: Jul. 7, 1987

[54] SKI BINDING

[76] Inventor: Gregory Williams, 20 May Road, Mt. Roskill, Auckland, New Zealand

[21] Appl. No.: 635,278

[22] Filed: Jul. 27, 1984

[30] Foreign Application Priority Data

Aug. 3, 1983 [NZ] New Zealand ..... 205133
Feb. 24, 1984 [NZ] New Zealand ..... 207265

[51] Int. Cl.[4] ..... A63C 9/08
[52] U.S. Cl. ..... 280/620; 280/624
[58] Field of Search ..... 280/624, 625, 631, 632, 280/635, 620, 618, 602, 607; 36/121

[56] References Cited

U.S. PATENT DOCUMENTS

| | | | |
|---|---|---|---|
| 2,669,459 | 2/1954 | Fleming . | |
| 2,676,813 | 4/1954 | Beyl . | |
| 3,606,370 | 9/1971 | Spademan . | |
| 3,747,235 | 7/1973 | Post | 36/2.5 AL |
| 3,753,571 | 8/1973 | Gertsch et al. | 280/11.35 K |
| 3,797,839 | 3/1974 | Smolka et al. | 280/11.35 C |
| 3,797,844 | 3/1974 | Smolka et al. | 280/11.35 C |
| 3,813,109 | 5/1974 | Salomon | 280/11.35 Y |
| 3,825,273 | 7/1974 | Greene | 280/11.35 K |
| 3,870,325 | 3/1975 | Davis | 36/121 |
| 3,931,982 | 1/1976 | Kubelka | 280/11 |
| 3,963,253 | 6/1976 | Rieger | 280/616 |
| 4,027,896 | 6/1977 | Frechin et al. | 280/618 |
| 4,135,735 | 1/1979 | Beyl | 280/618 |
| 4,141,570 | 2/1979 | Sudmeier | 280/607 |
| 4,172,602 | 10/1979 | Gertsch | 280/618 |
| 4,182,524 | 1/1980 | Beyl | 280/618 |
| 4,473,235 | 9/1984 | Burt | 36/121 |

FOREIGN PATENT DOCUMENTS 2340751 10/1977 France ..... 280/602

*Primary Examiner*—John J. Love
*Assistant Examiner*—Richard Camby
*Attorney, Agent, or Firm*—Holman & Stern

[57] ABSTRACT

A ski binding which has a bearing member and confinement means moveable relative to the bearing member to releasably confine a ski boot in use. Means are provided which are associated with the confinement means to maintain the confinement means in or to release the confinement means from the position wherein they hold the ski boot on the bearing member. The bearing member is elastically attached to a ski to allow relative elastic movement between the bearing member and the ski. Activating means are provided to act upon the means associated with the confinement means which release the confinement means when a predetermined relative movement of the bearing member relative to the ski has occurred. The predetermined movement in order to effect release must be lateral twisting or upward elastic movement or a combination of both. The activating means include release member which moves relative to the bearing member along substantially one line whether the bearing member undergoes lateral twisting upward or upward twisting movements. The invention also comprehends means to stress a ski which comprises levers mounted on the ski boot and a tensioning construction between the levers and the ski so that forward movement of the levers causes the tensioning means to stress the ski.

41 Claims, 14 Drawing Figures

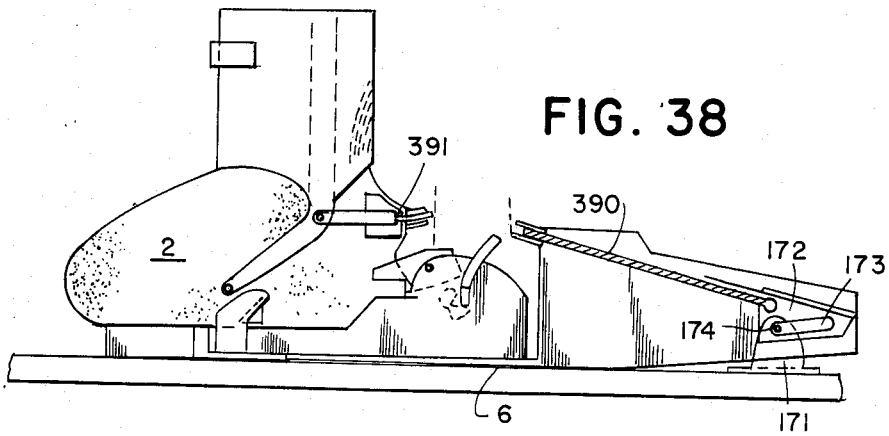
FIG. 38
FIG. 39
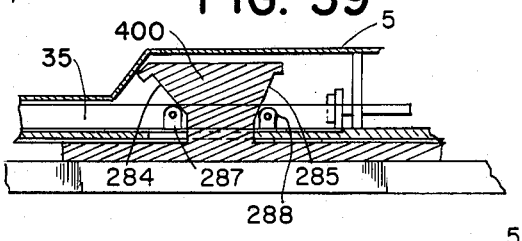
FIG. 40
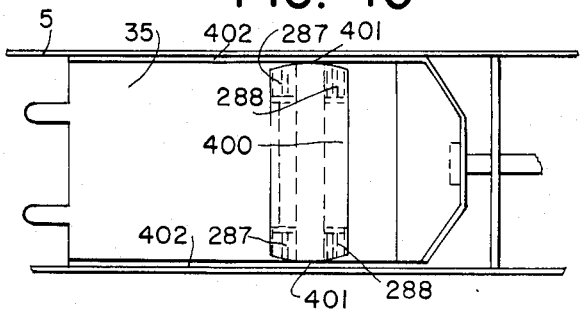
FIG. 41
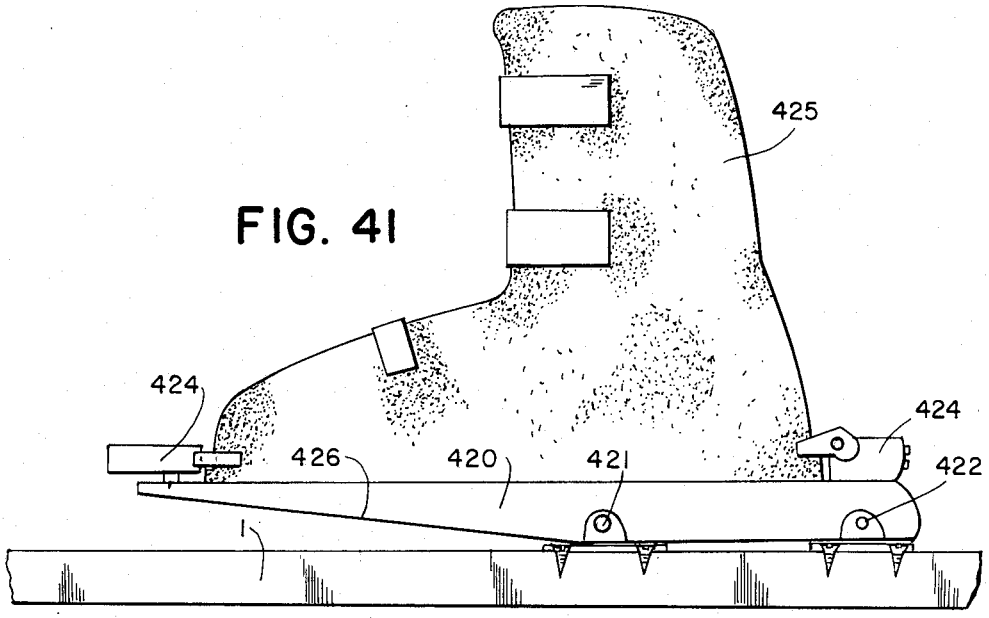

SKI BINDING

This invention relates to a ski binding.

It is stated in INTERNATIONAL SOCIETY FOR SKIING SAFETY 1979 SKI TRAUMA & SKIING SAFETY III. PUBLISHED BY TUV MUNICH W. GERMANY "As skiing continues to be one of the fastest growing sports in the world, it continues to attract the criticism of being highly dangerous. It is true that upwards of half a million people suffer some type of fracture as a result of skiing each year. Many more suffer countless varieties of soft tissue injuries, some leading rapidly to death, while others to some times permanent disabilities of joints and muscles."

At present a snow ski is controlled by the skier transmitting forces, substantially longitudinally with respect to the ski, by exerting pressure against the stiff calf portion of his ski boots. To enable sufficient leverage to be applied, this stiff calf portion of the ski boot often extends to the proximity of the knee. The ski boots are releasably attached to the ski and since the complete ski boot sole is substantially rigid, any forward force extended against the calf portion of the boot causes the heel of the ski boot to attempt to rise off the ski. This lifting force is directly absorbed by the downward pressure exerted by the ski binding. It is only when this downward binding pressure is sufficiently greater than the lifting forces applied by the skier that sufficient forces are actually supplied to the ski which is a prime objective. If the ski binding pressure is too low the skier will fail to sufficiently stress the ski for effective control but can also inadvertently cause the binding to open and to release the skier from the ski possibly in a dangerous situation even though normal and generally safe skiing is being undertaken at that time. Also if the binding pressure is sufficient to absorb the force applied by the skier during normal ski operation, and to transfer this force effectively and sufficiently to the ski, a force which could be damaging may be applied to the skier's legs without the ski binding safely releasing the skier from the ski. Thus the forces that the skier uses to control his skis can be a possible and continuing source of danger to himself. The pressure settings of the bindings are critical for successful and safe ski operation and these are very often incorrectly set by skiers of varying degrees of skill. It is documented that often more skilled skiers increase the binding pressures beyond safe levels in an attempt to further increase their skiing efficiency.

Ski Industry Sources, namely the Look Co. of France, which is a major skibinding manufacturing company states that in excess of 40% of accidents where injury results are caused by slow forward twisting falls. This type of accident causes forces to act on the skiers leg wherein a combination of the pressures required to release both the heel clamp and the toe holding mechanism of the standard skibinding are in play at one time and wherein friction plays a major part. It is especially this combination of pressures plus friction that can be of danger, doubly so when one or both of the boot holding mechanisms are set with too high a release pressure. Consequently the ability to reduce this combination of pressures either by reducing the number of springs or/and by reducing the pressures required to both hold the skier to the ski and to supply enough forces to control the ski will be of considerable benefit to both the skier and society generally with a consequential gain for society, by reducing the cost in time and money lost by the number of serious injuries.

At present no effective safe alternative is available to reduce the often dangerous binding pressures and yet to retain effective and efficient operation of the skis.

U.S. patent specification No. 3,963,253 (Rieger) describes a construction in which the ski boot is released from the binding upon a critical stressing of the leg occuring. However this device is disadvantageous as release of the boot can occur during ordinary skiing manoeuvres such as the commencement of a run or coming off a normal jump. As the skier applies pressure to his skiboots to control the ski, the binding plate (as depicted in the abovementioned specification), which has the disadvantage of being essentially "floating" underfoot, is stressed. This ability to "float" cause the stressing one way and then the other of the tension rods and also can cause the partial unlocking of the "separate" boot fastening devices, with much the same result as a conventional binding but with the further disadvantage of the "flexible under foot connection" with the ski, which can bounce continually when in use and can make the "reading" of the snow conditions extremely difficult and which when skiing bumps makes inadvertant release from the binding a distinct possibility. Also the Reiger construction requires the use of a stiff ski boot.

Furthermore ski boots currently available are manufactured of plastics and are substantially rigid often extending, as above stated, almost to the knee. The ankle joint is held in a permanent state of forward flexation, bringing the knees of the skier forward into a partial squat position. This position is exhausting and when combined with a substantially rigid sole makes walking extremely difficult under normal conditions and certainly hazardous when walking up or down hill on a icy surface while carrying skis or other ski equipment. It may also be physically damaging to have joints immobilized for long periods of time through lack of use and possible loss of blood circulation. Skiers often complain of cold fee and eventually loss of feeling in their feet because of these conditions. In an attempt to overcome this walking difficulty, temporary slip-on soles with convex lower surfaces are known which assist skiers to walk more naturally but even then the calf portion of the ski boot must be loosened to facilitate walking. Such aids are cumbersome and have to be removed before putting on the skis and therefore carried while skiing. Further plastic materials are also known to have substantial changes of flexing characteristics when subjected to even minor changes in temperature. It follows therefore that the inherent stiffness of ski boots in actual use conditions can vary substantially from that intended by the manufacturer. Some manufacturers have recognised this and have produced, at substantial cost, ski boots with calf portions which are horizontally pivotal and this fore and aft pivotal movement is controlled by friction force elements, or springs. Even hydraulic units have been considered.

It is therefore an object of the present invention to provide a ski binding which will obviate or minimise the foregoing disadvantages or which will at least provide the public with a useful choice.

Accordingly in one aspect the invention consists in a ski-binding comprising a ski-boot bearing member, one or more confinement means movable relative to said bearing member for releasably confining a ski-boot in use to said bearing member, said confinement means including associate means to maintain said confinement means in or release said confinement means from a confining attitute with regard to said ski-boot, means for elastically attaching said bearing member to a ski for elastic movement relative thereto, activating means which act upon said associate means for releasing said confinement means from said confining attitude with regard to said ski-boot and which are activated by a predetermined relative movement of said bearing member relative to said ski and wherein all operatively useful ski-boot confinement means release activating movements of said bearing member relative to said ski are lateral twisting or upward elastic movement or a combination thereof.

In a further aspect the invention consists in a ski binding comprising a bearing member elastically mountable on to a ski in use, one or more confining means movably mounted on said bearing member, said confining means engaging in use receiving means provided on a ski boot, release means to release one or more of said confining means upon movement in use of said bearing member relative to said ski beyond a predetermined limit or limits, said release means including a release member moveable relative to said bearing means so that upon movement of said bearing means in use and in at least one selected direction, said release member moves beyond a predetermined limit or limits relative to said bearing member, to release said one or more confining means to allow said ski boot to separate from said confining means, said selected direction comprising only lateral twisting, upward and upward twisting directions.

In a still further aspect the invention consists in a ski binding wherein said release member has a rearward extension which bears in use against a surface shaped so that as said bearing member moves said release member is moved relative to said bearing member by engagement of said extrusion with said surface. a ski stressing means comprising a ski boot, one or more levers mounted on said ski boot, tensioning means between at least one said lever and said ski.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention and modifications thereof will now be described with reference to the accompanying drawings in which.

Figure 2:
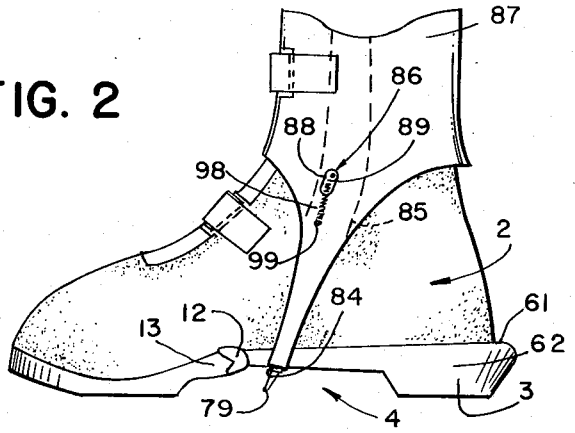
FIG. 2 is side elevation of the ski boot of FIG. 1 showing in greater detail, a part of a ski stressing mechanism.
Figure 1:
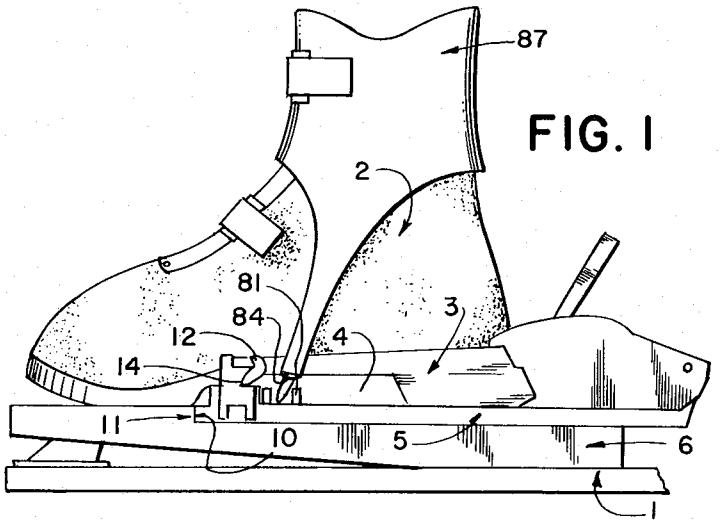
FIG. 1 is a side elevation of a ski boot, ski binding and part of a ski according to one preferred form of the present invention.
Figure 3:
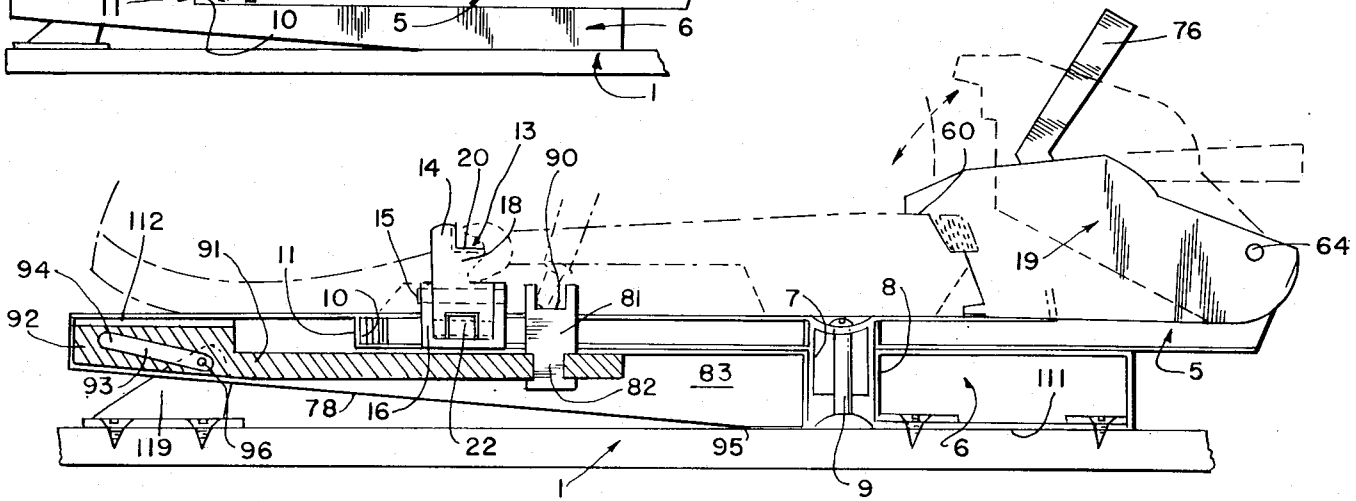
FIG. 3 is a side elevation of the construction of FIG. 1 showing in greater detail one alternative construction of the invention.
Figure 12:
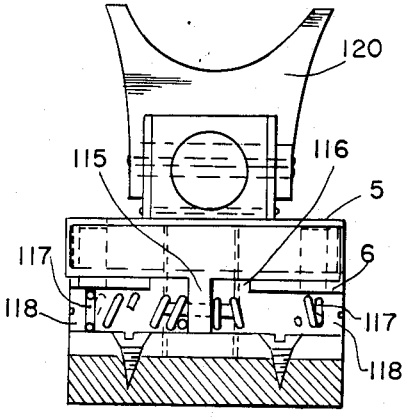
Figure 15:
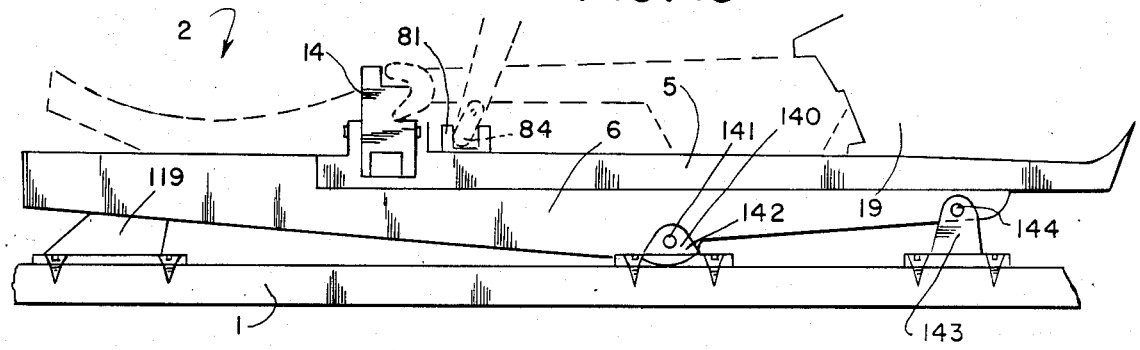
Figure 13:
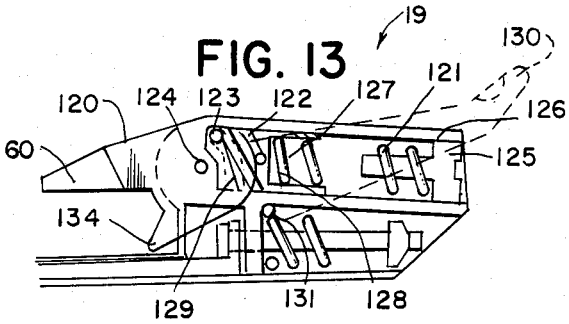
Figure 14:
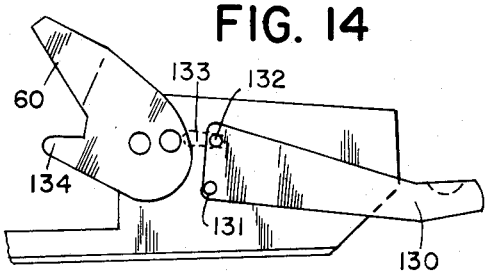
Figure 16:
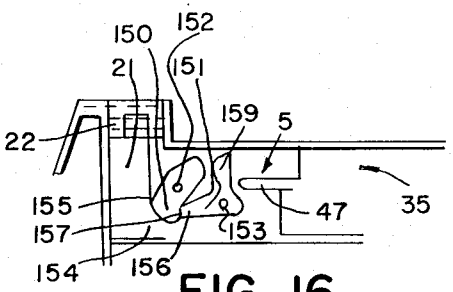
Figure 17:
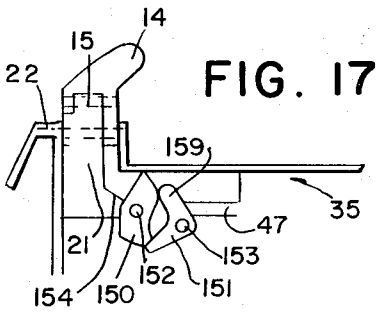
Figure 18:
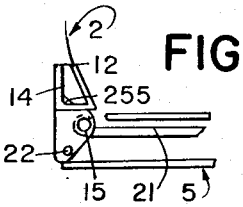
Figure 19:
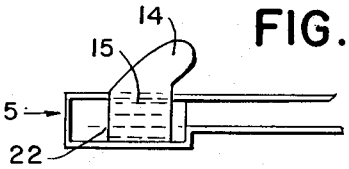
Figure 20:
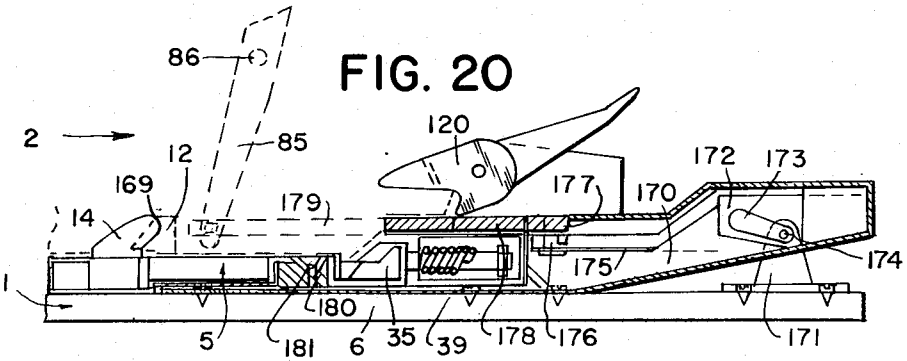
Figure 21:
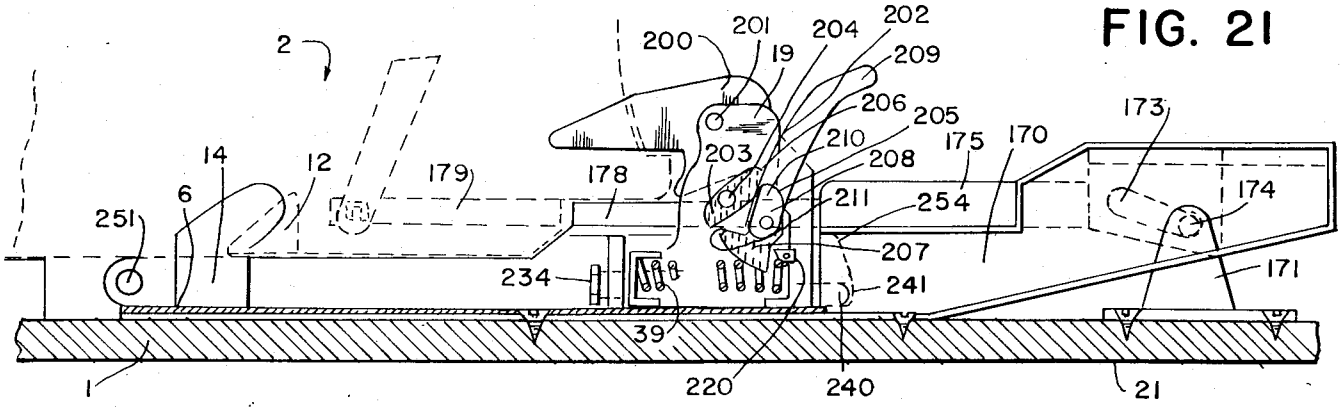
Figure 23:
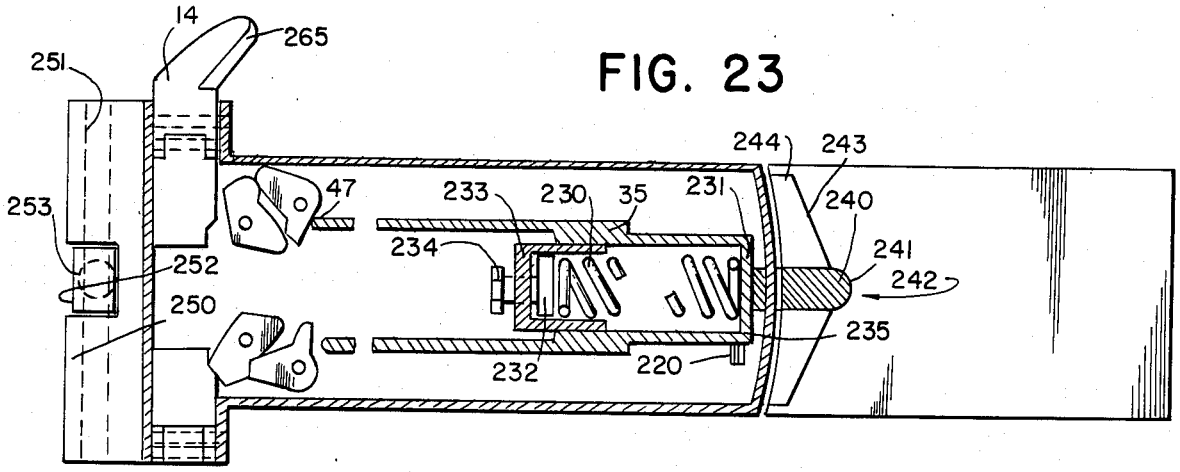
Figure 22:
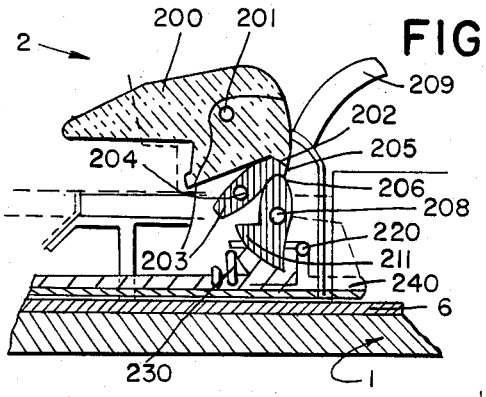
Figure 24:
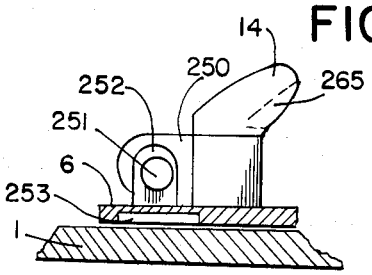
Figure 26:
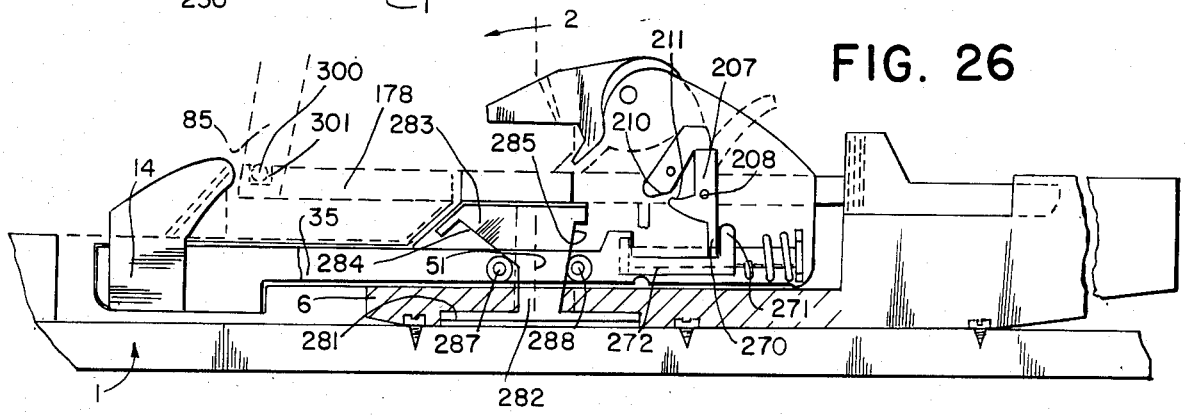
Figure 27:
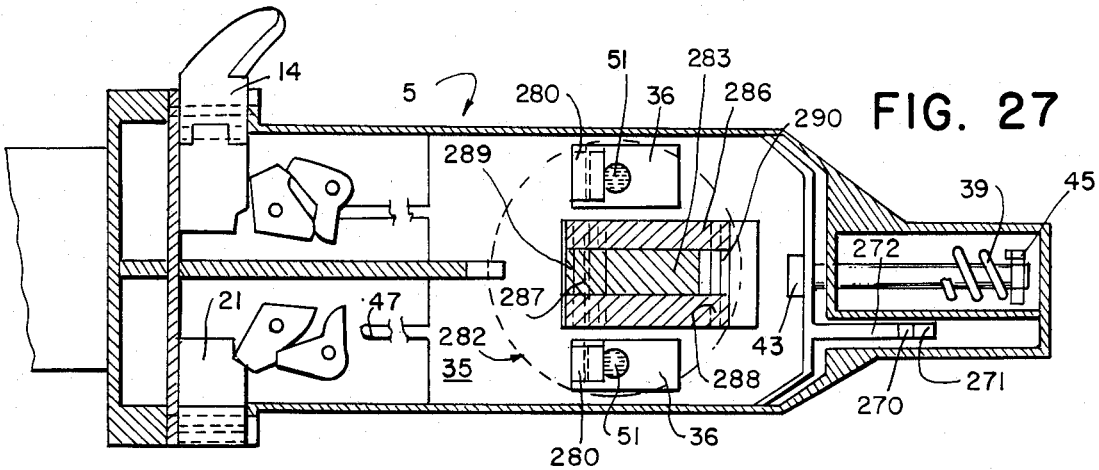
Figure 28:
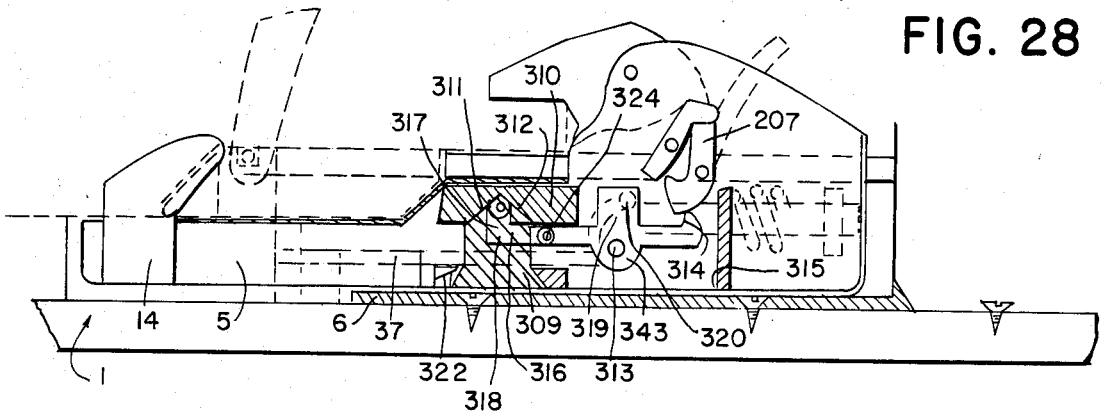
Figure 29:
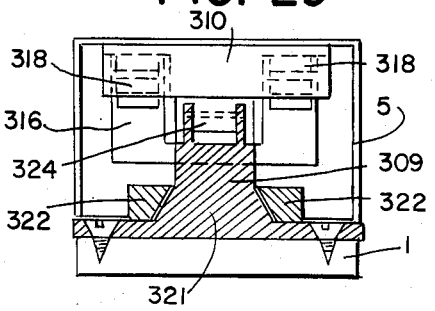
Figure 25:
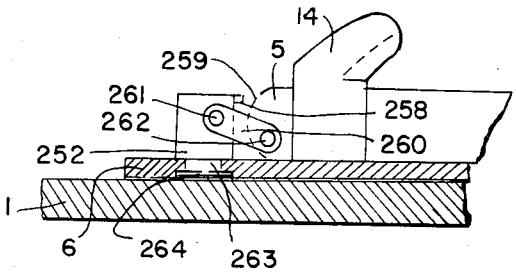
Figure 30:
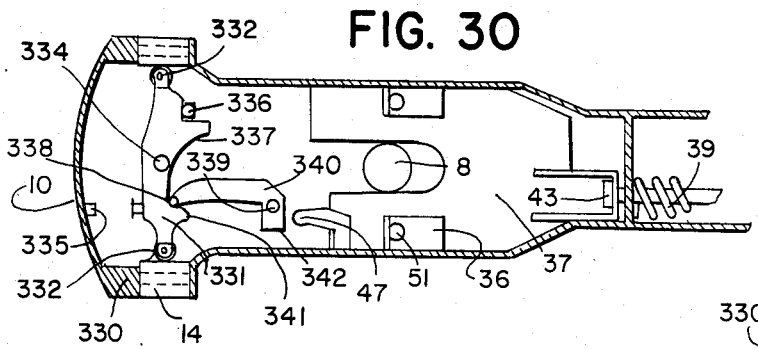
Figure 31:
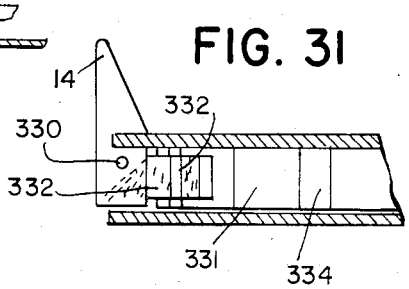
Figure 32:
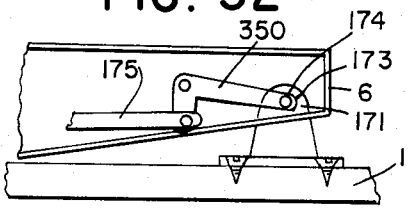
Figure 33:
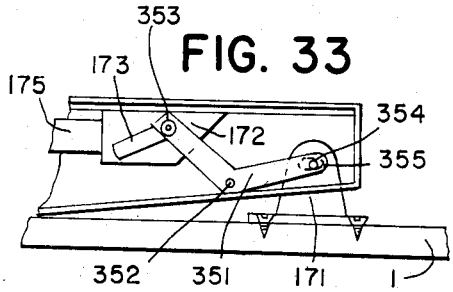

FIG. 12 is a cross sectional view of an alternative embodiment of the ski binding of the invention, FIG. 13 is a longitudinal sectional view of an alternative heel clamp useable in conection with the invention, FIG. 14 is a simplified diagram of the construction of FIG. 13 with the heel clamp in the open position, FIG. 15 is a side elevation of an alternative ski stressing mechanism according to one embodiment of the invention, FIG. 16 is a plan view of part of a release mechanism in an alternative embodiment of the invention, FIG. 17 is a view as in FIG. 16 with the side clamps of the construction in an open position, FIG. 18 is a front elevation of the construction of FIG. 16, FIG. 19 is an external side elevation of the construction of FIG. 16, FIG. 20 is a view as in FIG. 3 of an alternative embodiment of the invention, FIG. 21 is a view as in FIG. 3 of still further alternative embodiment of the invention, FIG. 22 is an enlargement of the heel part of FIG. 21, FIG. 23 is a plan view of the release mechanism of the construction of FIG. 21, FIG. 24 shows an alternative manner of connecting the ski boot confining means, bearing member or "retention member" of the invention to the intermediate member of the invention, FIG. 25 is a further alternative as in FIG. 24, FIG. 26 is a cross sectional view of a still further embodiment of the invention, FIG. 27 is a plan view of "the retention member" of the construction of FIG. 26, FIG. 28 is a longitudinal cross section of a still further embodiment of the invention, FIG. 29 is a transverse cross section through FIG. 28 and the position of rollers 318, FIG. 30 is a plan view of a still further release mechanism according to one preferred embodiment, FIG. 31 is a cross section through part of the construction of FIG. 30, FIGS. 32 and 33 are diagrammatic side elevations of still further stressing mechanisms according to a preferred form of the invention.

Figure 4:
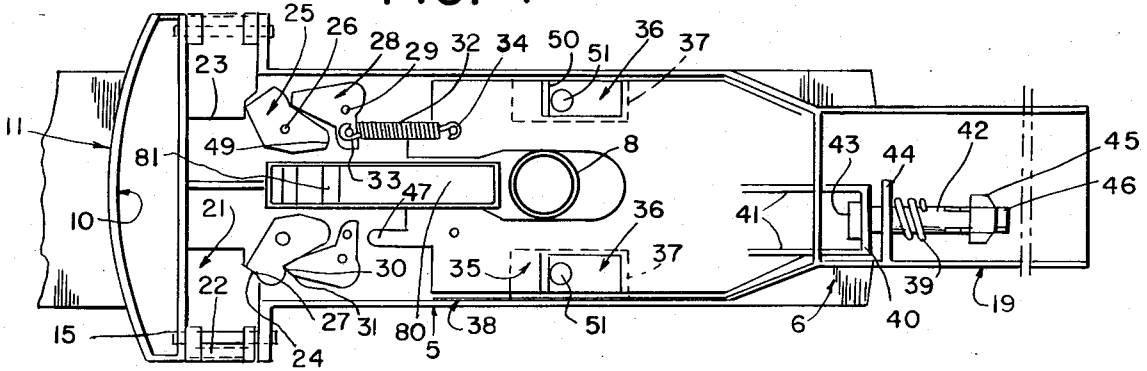
FIG. 4 is a plan view of a retention member and release member for use in a ski, ski boot and ski binding combination according to one preferred form of the invention.
Figure 5:
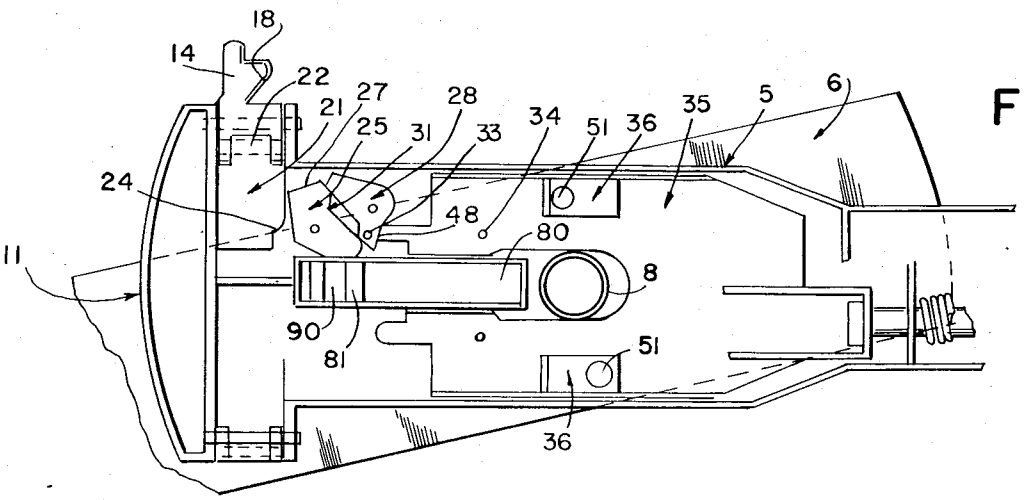
FIG. 5 is a view as in FIG. 4 showing the construction pivoted into an unlocked position.
Figure 34:
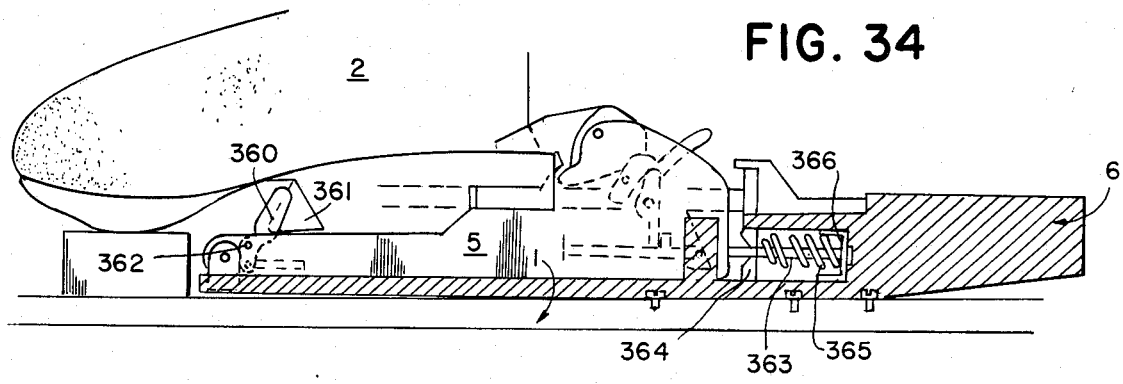
Figure 35:
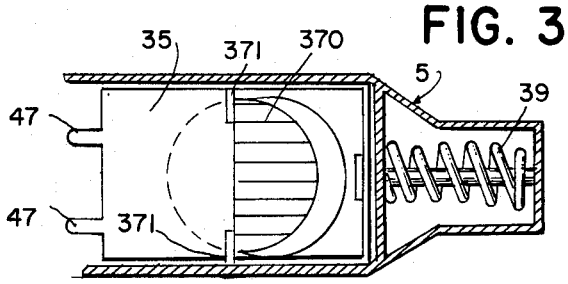
Figure 36:
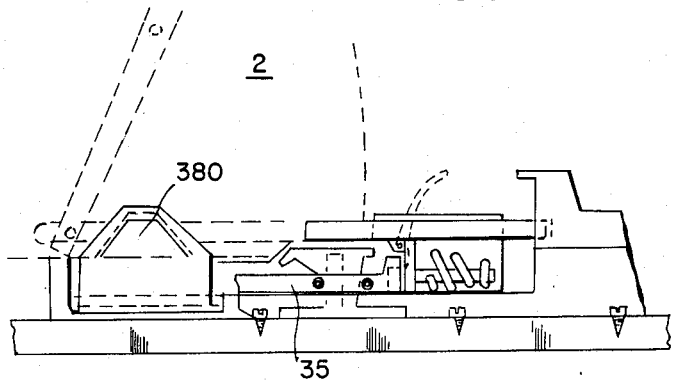
Figure 37:
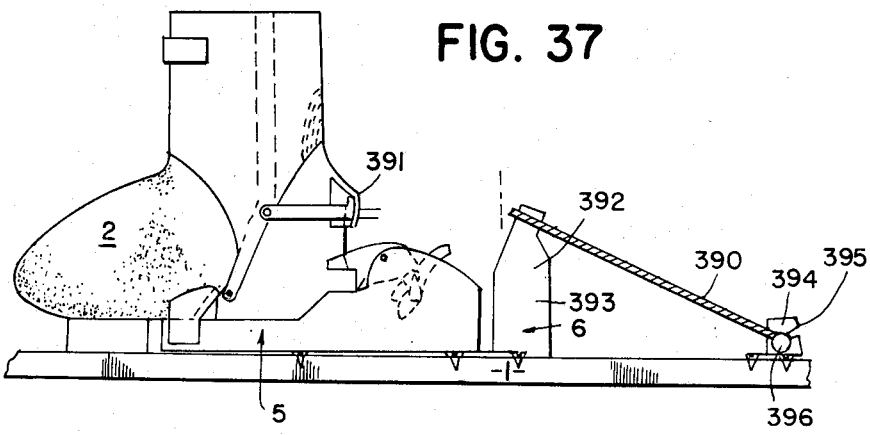

FIG. 34 shows a still further alternative construction,

FIG. 35 is a plan view of an alternative construction to that shown in FIGS. 4 and 5, FIG. 36 shows an alternative boot confining member or "latch" arrangement, FIGS. 37 and 38 show an alternative ski stressing mechanism, FIGS. 39 and 40 show a variation to the construction of FIGS. 26 and 27, and FIG. 41 shows an alternative inventive construction.

Referring to the drawings a ski boot, ski and ski binding combination is provided as follows:

By reference to FIGS. 1 to 8 a ski 1 is provided and ski boot 2. The ski boot 2 is provided with a sole 3 of which the forward part is desirably flexible and with a hollow arch portion 4. A ski boot bearing member or retention member 5 is provided as are means to elastically attach the bearing member 5 to a ski in use. The bearing member 5 is pivotal with respect to the ski and is preferably mounted on an at least partly hollow intermediate member 6 the purpose of which will be further described hereinafter. The intermediate member could of course form part of the ski. The intermediate member 6 is fixed to the ski 1 or is constructed as part of the ski 1. Thus the bearing member 5 may have a downward circular spigot shaft 7 fitting in a socket 8 provided in the intermediate member 6, a pin, or 9 preferably a screw or bolt, being provided through apertures in the upper surface of the spigot 7 and the bottom surface of the socket 8 so as to retain the bearing member 5 and intermediate member 6 pivotally together. The male and female elements can be reversed.

The leading edge 10 of the bearing member 5 is desirably of arcuate construction and the construction of the intermediate member 6 preferably provides a step at 11 of a matching arcuate outline or bearing member 5 can co-act with the top of intermediate member 6. Thus the bearing member 5 may pivot transversely of the ski 1 in use, when too great a twisting force prevails on the skiers leg.

In order to maintain the ski boot 2 in normal engagement with the ski 1, in particular the bearing member 5, each side of the ski boot 2 is provided with suitable members, notches or recess 12. These are preferably outwardly extending protrusions having a forward facing substantially V-shape notch 13.

Pivotally mounted on the bearing member 5 are confinement means such as two or more boot confining members, such as two latches 14 and these may be mounted by means of a pivot pin 15 passing through apertures in a bifurcated bracket 16 and a further aperture in latch 14. Such latch 14 has an outward and rearward protrusion 18 which in use engages in the notch 13 so as to substantially prevent, in conjunction with a heel holding device 19, lifting of the ski boot from the ski when the catches are in the locked position.

The upper surface 20 of the protrusion 18 may be flattened as shown in FIG. 3, if desired.

The latches 14 must in normal use be locked to substantially prevent accidental removal of the boot 2 from the ski binding and the locking may be achieved, by the use of associated means, in the following manner. A tongue 21 is pivotally mounted on the catch 14 by means of pivot pin 22 and the tongue 21 extends inwardly into the bearing member 5.

The trailing edge 23 of the tongue 21 has a notch 24 and a cam 25 is provided pivotally mounted to the bearing member 5 by pivot pin 26. Thus with the cam 25 in the position shown in FIG. 4, further inward movement of the tongue 21 is substantially prevented by the positioning of a protrusion 27 on the cam 25 in the notch 24. Tongue 21 can, if required, be eliminated and a cam can act directly onto any suitably angled face of latch 14.

The side edge of the notch 24 at an angle to the general longitudinal axis of the retention member 5 and to the pin 26 of cam 25. This angle is marginally more than 90° to a line drawn passing through the centre of pivot pin 25, on the side at which a further cam 28 is situated but the angle is not so great as to cause undue slippage. In order to maintain the cam 25 in this position a second cam 28 is provided pivotally attached to the bearing member 5 through a pivot pin 29. The cam 28 has a forward protrusion 30 which is positioned in a notch 31 oppositely positioned to protusion 27.

The angle formed by the respective touching faces of notch 31 and protusion 30 of cams 25 and 28 are slightly more than 90° on the open side to a line drawn through the centre of pivot pin 29, but the angles are not sufficient to cause or allow any slippage but are sufficient to allow working clearances.

The cams 25 and 28 may be returned to these respective positions by the biasing of bias means such as a tension spring 32 engaged between a suitable pin 33 or cam 28 and a pin 34 mounted on a further member which may comprise a biased activating means such as release member 35. A suitable hairpin spring operating between the back of cam 28 and side wall 38 of bearing member 5 may be a useful alternative.

One purpose of the release member 35 is to release the cams 25 and 28 and to this end release member 35 is provided with a pair of cut-outs 36 which are positioned above suitable cut-outs 37 in the bearing member 5. The release member 35 may therefore slide between the edge walls 38 of the bearing member 5. The release member 35 is therefore constrained to move substantially along a single line and may be retained in a withdrawn position by a suitable biasing construction such as compression spring 39 connected between the release member 35 and suitable securing point, for example in the heel catch 19. An extension spring or a rubber compression member could be suitable alternatives. To this end a wall 40 may be provided on the release member 35 which may be supported by bracing walls 41. An aperture is provided in wall 40 through which extends a rod 42 having an enlarged head 43 to limit the extent of movement of rod 42 through the aperture in wall 40, wall 44 is provided as part of heel catch 19 and spring 39 is retained between wall 44 and a stop such as nut 45 on threads 46 on rod 42. The rod 42 passes through an aperture in wall 44.

The forward end of the release member 35 may have a pair of striking probes 47 which strike an arm 48 of cam 28 so causing cam 28 to be rotated almost to the position shown in FIG. 5 wherein the protrusion 30 is removed from notch 31. At this time the forward part of arm 48 will strike part 49 of cam 25 causing cam 25 to rotate so that the cam 25 is removed from notch 24. Tongue 21 can then move inwardly. In these circumstances the protrusion 18 on the catch 14 is able to fall from the notch 13 in member 12 allowing the boot to become separated from the bearing member 5.

When bearing member 5 returns to centre, drawn by spring 39 operating on release member 35 so that the leading edges 50 of apertures 36 come against pins 51 equally this extends springs 32 (one not shown) which in turn biases cam 28 and another side of protuberance 30 rides on the curved part of protruberance 27 so that when tongue 21 moves outwardly the cam 25 will reenter notch 24. Tongue 21 can be drawn, for example, outwardly by a spring (not shown).

The release member 35 is caused to move forwardly to cause the probes 47 to push arm 48 by means of the pins 51 which extend upwardly from the intermediate member 6 so that rotation of the bearing member 5 relative to the intermediate member 6 will cause a pin 51 to push an edge 50 of the aperture 36 in which pin 51 is positioned thereby moving the release member 35 forwardly so that probes 47 engage arm 48. Thus the degree of pivotal movement of bearing member 5 before ski boot release can be predetermined by varying the distance of travel of release member 35 before probes 47 contact protuberance 48 of cam 28. Thus a predetermined delay before release can be built into the binding enabling a range of bindings with differing delays to be provided.

The heel clamp 19 includes an overhang 60 which is able to bear on the upper surface 61 of a rear extension 62 of the sole 3 of ski boot 2.

Figure 8:
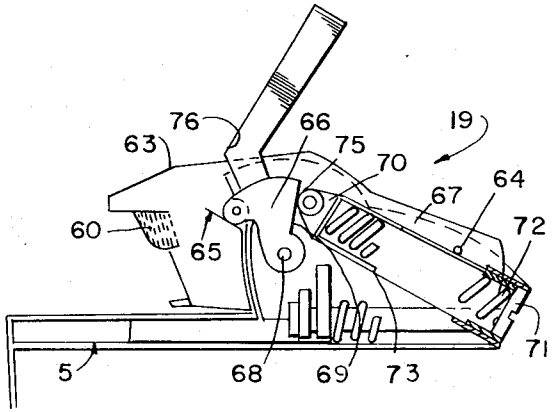
FIG. 8 is a side elevation of a rearward heel clamping device usable with some aspects of the present invention.

The overhang 60 is able to be retained in the clamped position by suitably shaping part 65 of the housing 63. The rear clamp 19 is pivotally attached to the retention member 5 at 64. The housing 63 carries internally a ledge or stop 65 sloped at an angle which is held down by cam follower 66. The cam follower 66 is pivotally mounted on a member 67, preferably a channel member extending from bearing member 5 within the housing 63, the cam follower 66 being pivotally mounted to member 67 through pivot pin 68. The back surface 69 of the cam follower 66 is positioned against a pressure stop such as tubular slide 70, the pressure of which can be varied by operating a screw 71 to tighten or loosen compression spring 72 contained within a housing 73 mounted on bearing member 5 and mounted integral with member 67. With the heel clamp in the position as shown in FIG. 8, sufficient upward force must be applied to overhang 60 and thereby cam 65 to force cam 65 past the cam follower 66 causing cam follower 66 to pivot so that surface 69 will be forced against the slide 70 which may mount a roller or wheel 75. This movement can be achieved manually by operating a lever 76 and an indication of this can be seen in FIG. 3.

In order to stress the ski 1, a tensioning device is provided.

Figure 7:
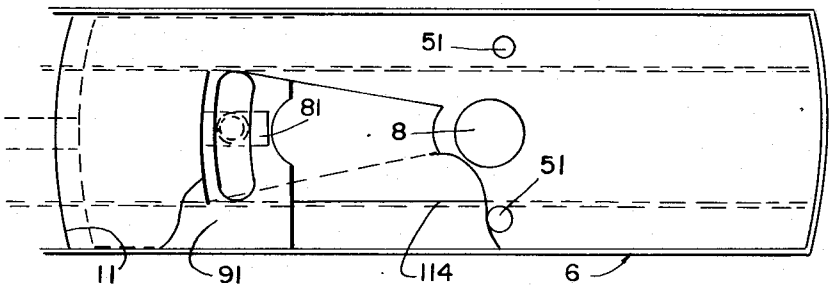
FIG. 7 is a plan view of an intermediate member for use with the ski, ski boot and ski binding combination of the invention.
Figure 6:
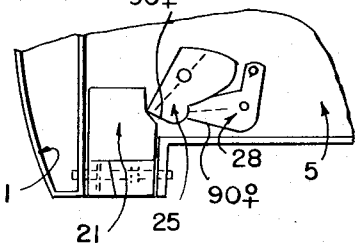
FIG. 6 is a plan detail of part of the construction of FIG. 4 showing clearances to allow continued pivotal movement of the boot after the locking device has been triggered; and to show the relationship of cams used in the construction.

A longitudinal slot 80 is provided in the bearing member 5. A bifurcated member 81 is provided which is able to move forwardly and backwardly in the slot 80 and the lower end 82 of the bifurcated member 81 is positioned within the hollow 83 of the intermediate member 6. A cross bar 84 is provided in the arch 4 of the ski boot 2 and the cross bar 84 connects levers 85 positioned one each side of the ski boot 2. The levers 85 are biased upwardly and pivotally connected to the ski boot at 86. The levers 85 are also connected to the user's leg by a temporarily fixable wrap-around 87 which is engaged with the levers 85. Lever 85 has a slot 88 in which pin 89, which is mounted on boot 2, moves. The upward bias is provided, for example, by a spring 98 between pin 89 on the boot 2 and an attachment pin 99 on the lever 85. The cross bar 84 mounts a short stud 79 which is positioned, in use, in the slot 90 in the bifurcated member 81. One or both of the bifurcation wings (arms) of member 81 may be spring loaded. This spring loading being such as to allow ease of placement of the stand 79 within their confines when mounting the boot to the bearing member 5. This spring loading also being such that stud 79 is retained therein until release from the binding occurs accidental or otherwise. In the construction of FIGS. 3 and 7, the lower end 82 of the bifurcated member 81 is positioned through an aperture in intermediate member 6 to co-act with connecting member 91 the forward end 92 of which has a transverse slot 93 which rises towards its forward end 94. The ski 1 carries an upwardly extending bifurcated plate 95 having a cross member or roller 96 therein which is positioned in slot 93. The slot 93 is at a jamming angle so that movement of roller 96 in slot 93 is substantially independent of pressures on the ski in use. Thus referring to FIGS. 3 and 10 as the bifurcated member roller 82 is drawn rearwardly so also is slot 93 thereby causing the intermediate member 6 to be drawn downwardly towards the ski 1. Roller 82 and its associated bifurcated member 81 are positioned in an arcuate slot in member 91 transversly located in relationship to the longitudinal axis of the ski 1, so as to allow pivotal movement of retention member 5 without undue impediment. As can be seen from FIGS. 3 and 10 in this embodiment of the invention, the intermediate member 6 has a bottom surface 111 with an angle formed at 119 so as to provide a forwardly extending upwardly sloped surface 78 or which may be a gradual curve so that there is no angle at 119. As the forward end of the intermediate member 6 is drawn towards the ski 1, the forward end of the ski 1 will be drawn upwardly in use but can be forced downwardly by the forward motion of the skiers weight thereby lifting the rear of the ski 1. Alternatively a skier can if this is required can stress the ski by moving the calves forwardly, and can then if it is so required can, leave the rear of the ski on the snow by keeping his weight rearwardly. Connecting member 91 is maintained in position by a web 112 positioned between the upper parts 113 of member 6 and inwardly extending strengthening members 114 forming part of the intermediate member 6. If stressing of the ski is not required the intermediate member can be reduced in thickness to provide only the pins 51 and the socket 8. In fact the pins 51 an socket 8 could be provided as part of the ski 1 in such a construction.

Figure 9:
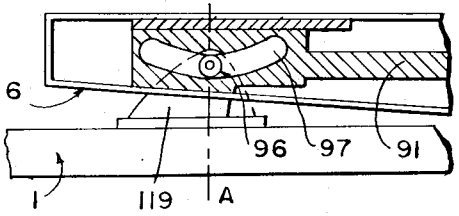
FIG. 9 is a view as for the forward part of FIG. 3 showing an alternative ramp construction.

FIG. 9 shows an alternative construction wherein slot 97 extends upwardly, rearwardly and forwardly which requires, of course, the levers 85 to be centrally positioned when at rest so that the ski is stressed with movement of the skier's leg backwardly, because the skier's weight is backward and the front of the ski rises up of the snow. Movement of the skier's leg forwardly will stress the ski as the skier's weight is forward and the rear of the ski rises off the snow. These constructions allow the ski to be manufactured with an elastic centre in between the point of contact 119 of the intermediate member and the member 95 of the construction described rather than the substantially stiff construction presently known. This can be achieved reducing or eliminating reinforcing of the ski 1 in this area by utilising the strength of the intermediate member 6. The ski can also have a single central or a double edge keel construction either part of the length or the full length of the ski. A keel extending part of the length under the binding is preferred.

Figure 11:
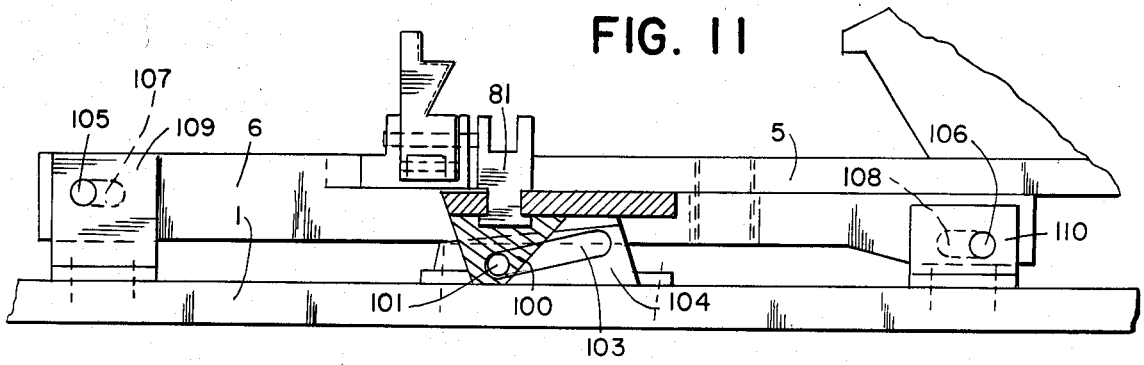
FIG. 11 is a view as in FIG. 3 showing an alternative ski stressing mechanism.

FIG. 11 shows a further alternative construction. In this construction the bifurcated slide 81 has a connecting member which extends downwardly. The connecting member which may have bifurcated wings 100 carries a cross member 101 which slides in an upwardly extending slot 103 in upwardly extending plate 104 connected to the ski 1.

The intermediate member 6 may also be connected to the ski by providing outwardly extending lugs or pins 105 and 106 and rearward and forward ends which pins move in slots 107 and 108 in brackets 109 and 110. Rearward movement of the bifurcated member 81 will cause the cross bar 101 to move upwardly in the slot 103 thereby again stressing the ski 1. It will be appreciated that one bracket 109 or 110 could be directly affixed to the member 6 if desired.

In an alternative embodiment shown in FIG. 12 instead of the recentering device operating off the two pins 51, a lug 115 is provided situated rearwardly or forwardly as required of the pivot formed by spigot 7 and socket 8 and projecting downwardly through a hole 116 in the upper surface of the cantilever 6 and the lower surface of the bearing member 5 to be held resiliently fixed by one or more laterally mounted springs 117, two such springs being shown in FIG. 12. The springs would be mounted within the intermediate member 6 and adjustable as to pressure for example by screws 118. The pins projecting into the pivotal part of the binding would only be used to drive the combination member 35 forward and another small spring would be used to return the combination member 35 to its original position.

Referring now to the construction of FIGS. 13 and 14 the forward projecting lip 60 which clamps the heel of the ski boot 1, extends from a pivotal member 120 which is retained exteriorly of the rear housing 19. The pivotal member 120 is biased into a downward or clamping position by the forward pressure of a compression spring 121 which is transmitted through a contact member 122 which bears against pin 123 which is mounted on or integral with pivotal member 120. The pivotal member 120 rotates around a pin 124. With the boot heel clamp of FIG. 12 sufficient upward force must be applied to lip 60 to cause pin 123 to push the member 122 rearwardly so as to compress the spring 121. The pressure of spring 121 may be varied by means of screw 125 which is positioned in tube 126 extending rearwardly behind the rotational member 120. Screw 125 and the inner end surface of tube 126 have matching threads therein. The spring 21 is held between the stem of screw 125 and a recess 127 in the rear of member 122. Rotation of screw 125 therefore will either compress or allow extension of the spring 121 by decreasing or increasing the distance between the forward face of screw 125 and the rearward face 128 of the member 122. The forward face of member 122 is tapered rearwardly at 129 and pin 132 resists retention of member 122.

To allow deliberate release of the ski boot 1, rotational upward movement of the lip 60 is able to be achieved manually. To this end a lever 130 is provided pivotally mounted by pin 131 to the housing 19. A further pin 132 moves in a slot 133 in member 120. This lever 130 is in effect a bell crank and when lever 130 is depressed thereby compressing spring 121, a spring not shown, but bearing upwardly against clamp 120 raises clamp 120 to the open position. When the downward pressure is removed from lever 130 the main spring 121 reasserts itself against member 122, which in turn presses against pin 123 which slides down angled face 129 to maintain 120 in the open position. When in use upwardly heel pressure causes the member 120 to rotate sufficiently against the pressure of spring 121 so that pin 123 is rotated against face part 129. The heel of boot 2 may become released from the clamp. The lip 60 will remain raised after either downward pressure on lever 130 has been removed or when the upward force on lip 60 has been removed. The rotational member 120 and the lip 60 can be downwardly moved or biased, for example, by heel pressure on a flange 134 extending from the rotational member 120 at a position below the lip 60. Such pressure is exerted until the pin 123 is removed from the face 129 of member 122. The spring 121 tends to hold the member 120 in the position shown in FIG. 13.

FIG. 15 shows an alternative method of connecting the intermediate member 6 to the ski 1. In this construction a hinge mechanism is shown whereby a hinge construction is provided by providing a lug 140 and pivot pin 141 which engage the intermediate member 6 which is provided with one or a pair of lugs at 142. The intermediate member 6 is further connected to the ski 1 by lug 143 extending a upwardly from the ski 1 which is engaged with the intermediate member 6, for example, by a pin 144. In this construction rearward movement of the bifurcated member 81 utilizing a mechanism such as shown in FIGS. 3 or 11 and in particular the construction of FIG. 3, will cause the intermediate member 6 to pivot around the pin 141 to thereby stress the ski.

In the embodiment of FIGS. 16 and 17 the tongue 21 is held back by a pair of cams 150 and 151 pivotally mounted to the retention member 5 by pivot pins 152 and 153. The tongue 21 is wider at its inner end to provide a sloped surface 154 against which a protrusion 155 on cam 150 bears. Cam 151 has a forward arm 155 which normally butts against surface 157 as shown in FIG. 16 to retain the tongue 21 in its withdrawn position.

As can be seen in FIG. 17 when the combination member 35 moves forwardly the arm 47 strikes arm 159 of the cam 151 thereby rotating the cam 151 and removing arm 158 from engagement with surface 157. Because of the sloped nature of surface 154 the cam 150 will rotate releasing the tongue 21 to allow the tongue 21 to move outwardly thereby allowing catch 14 to be removed from the ski boot 2 substantially as described with regard to FIGS. 4 and 5.

In the embodiment of FIG. 20 the retention meber 5 is formed substantially as in FIG. 3 though it will be seen that the protrusion 12 on each side of the boot is shown having a single sloped forward surface 169 and the latch 14 is shaped to engage that surface. The retention member 5 is mounted on an intermediate member 6, but the intermediate member 6 is reduced in size in effect to the form of a plate below the bearing member 5 but is extended at behind the retention member 5 to provide an operational chamber 170.

One or a pair of members 171 extend from the ski 1 into the operational chamber 170 and within that chamber is provided a block 172 having a slot 173 therein so that a pin or roller 174 may be positioned in the slot 173 and engage with the one or pair of members 171.

Figure 10:
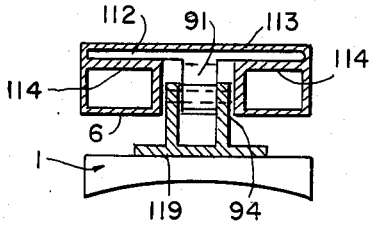
FIG. 10 is an end elevation through a section A—A in FIG. 9.

The block 172 is supported as in FIGS. 3 and 10 and is extended forwardly by an arm 175. Slide 178 mounts a vertical roller 176, which roller 176 co-acts with an arcuate forward edge 177 of arm 175. Slide 178, interconnecting roller 176 and arm 175 can be moved rearwardly by being pushed by arms or slide 179 which are moved by rotation of ski boot lever 85 about their pivot at 86. Member 179 can be a bifurcated pair of arm outside the ski boot joining together to make one face where they co-join slide 178 at the rear of the ski boot or they can be altered to constitute one slide member running through the heel of the ski boot. As a skier leans forwardly there is a rearward movement of the arms 179 to move the plate or slide 178 so that roller 176 pushes against the arcuate edge 177 to thereby move arm 175 rearwardly to cause the pin and roller 174 to move in slot 173 to thereby stress the ski. The members 5 and 6 may be connected together by providing a spigot 180 extending upwardly from the member 6 so that a socket on member 5 may be dropped over the spigot 180 and fixed, for example, by screw 181.

With reference to the constructions shown in FIGS. 21 to 24, a heel clamp arrangement is provided which comprises an overhang member 200 fixed to the housing 19 by a pivot pin 201.

A notch 202 is provided on the lower surface of the overhang member 200 and a cam 203 is provided rotating about a pivot pin 204.

The cam 203 is shaped to be positionable in the notch 202. A notch 205 is provided on the opposite surface of that cam into which is positionable an arm 206 or a further cam 207. The further cam 207 is mounted to the construction, in particular bearing member 5, by a pivot pin 208. A lever 209 is provided fixed to the cam 207.

The cam 203 has a rear surface 210 which is able to be struck by a protrusion 211 on the cam 207. With the construction in the position shown in FIGS. 19 and 20, the heel overhang 200 will be locked onto a ski boot heel.

If the lever 209 is moved in a clockwise direction, the arm 206 will be removed in clockwise direction and then the protrusion 211 will strike the surface 210 thereby removing part of the cam 203 from the notch 202 thus allowing the overhang 200 to rise.

It is also envisaged that a striking member 220 be provided on the release member 35 thereby as the release member 35 move forwardly the striking member 220 will strike cam 207 thereby also causing the heel clamp to be removed thus facilitating removal of the ski boot 2 from the ski 1. Clamp 200 is provided with a spring (not shown) to facilitate upward movement after cam 203 has been moved by pressure on the lever 209. Lever 209 is provided with a return spring (not shown) to return lever 209 to start position at such time as clamp 200 is placed in the closed and clamped position substantially as hereinbefore described.

A modified embodiment of release member 35 is also shown in this embodiment.

The release member 35 terminates in a housing 231 for a spring 230 which is engaged between the rear 235 of the housing 231 and a pressure plate 232. The pressure plate 232 is held within a further housing 233 extending downwardly from the upper part of the bearing member 5.

A screw 234 may pass through the forward wall of the housing 233 to bear against the pressure plate 232 so as to be usable to adjust the tension in compression spring 230.

The release member 35 extends rearwardly at 240 through the rear wall of the retention member 5 so that the rear protrusion may be placed into a notch 241 formed in a back plate 242 on the ski which may form part of intermediate member 6.

Thus if the bearing member 5 is pivoted the rearward extension 240 of release member 35 will be forced from the notch 241 moving along one of surfaces 243 thereby forcing arms 47 forwardly to release the latches 14 and heel catch 200 substantially as previously described. End members 244 prevent the movement of the protrusion 240 beyond the point where the protrusion 240 will pivot pass the end walls 244.

In this construction engagement of the bearing member 5 to the intermediate member 6 may be as follows:

At the front of the bearing member 5 may be a transverse member 250 having an aperture through which a pivot or axle 251 extends. A cut-out is provided in member 250 into which is positioned a block 252 pivotally attached either to plate 6 or ski 1 through a pivot pin 253. The pivot pin 253 allows rotational movement in the plane of the ski. The pivot pin 251 also passes through the block 252 and therefore the bearing member 5 may also pivot in a plane normal to the plane of the ski. Should pivoting occur, about either one or a combination of axes then protrusion 240 will run up sloped faces 254 and 243 of the rear member 242 again causing the combination member 35 to be moved forwardly to release the latches 14 and the heel clamp 200.

Latch 14 is sloped back at 265 to provide a clearance angle, or when the boot 2 is in the binding a jamming angle. There must be some further clearance radius at 255 (FIG. 18).

FIG. 25 shows a construction similar to FIG. 24 except that the block 252 is now separated from the leading part 259 of the bearing member 5. The block 252 and bearing member 5 are connected by a link 260 which is pivotally connected to the block 252 at 261 and pivotally connected to the bearing member 5 at 262. The block 252 has at its lower end a stem 263 which passes through an aperture in the bearing member 5 and which terminates in a pivot plate 264 fitted into a recess in the underside of the release plate 6. Stop 258 prevents rotation of link 260 beyond a desired point. Parts 260, 261, 263 and 264 could be replaced by a ball and socket universal joint. Similarly for the construction of FIG. 24.

In the construction of FIGS. 26 and 27, a heel clamp release mechanism sutstantially as shown in FIG. 21 is provided except that the lower cam 207 has a downward extension 270 behind which is positioned an upward extension 271 provided at the end of an arm 272 which extends rearwardly from the release member 35. Thus again any forward movement of release member 35 will cause arm 271 to strike arm 270 thus releasing the heel locking mechanism and catches 14. Movement of the release member 35 in this embodiment is substantially similar to the construction shown in FIGS. 4 and 5, except that the pins 51 are elongated and bear against rollers 280 mounted in the forward edge of the apertures 36. An aperture is provided through the intermediate member 6 terminating in a recess 281. Positioned in the recess 281 is a flat circular member 282 which mounts a pedestal 283 which extends upwardly through the aperture of intermediate member 6 and through corresponding apertures in the bearing member 5 and release member 35.

The pedestal 283 at its leading edge firstly extends upwardly and then moves to a forwardly rising surface 284 whilst the rear surface rises rearwardly upwardly at a steep angle as at 285. These angles can be varied as necessary. Each side of the pedestal 283 are positioned cheek plates 286 which form part of or are mounted on the bearing member 5. Release member 35 is provided with a front axle 287 on which is mounted a forward roller 289 and between the cheek plates 286 is provided a rear axle 288 upon which is mounted a rear roller 290.

A forward or rearward upward tilt of the bearing member 5 will cause the rollers 289 and 290 to be drawn along surfaces 284 and 285 respectively thereby pulling release member 35 forwardly and causing extension member 271 to hit member 270, thereby unlocking the heel clamp and unlocking latches 14 substantially in the manner previously described.

Lateral pivoting of the bearing member 5 achieves release of the latches 14 substantially as hereinbefore described. The extra length of pins 51 or substitute cam, as shown in FIG. 35 accommodate a combination of lateral and upward pivotal movement of bearing member 5 and thereby achieving release of the latches 14 and heel clamp 200 as previously herein described.

The pedestal 283 can be made slightly thicker at its base and the cheek plates 286 constructed accordingly to facilitate an easy return to a start position.

As an alternative the pins 51 may be constructed with a upward forwardly sloping surface. This allows the forward slope of pedestal 283 and roller 287 to be deleted.

The construction of FIGS. 28 and 29 is similar. The intermediate member 6 is extended upwardly by tapered spigot 309 and terminates at its upper end in a block 310 with a V-shaped groove therein poviding slope surfaces 311 and 312. Pivotally mounted to the bearing member 5 is a member 343 mounted by pivot pin 313. The member 343 has a rearward extension 314 mounting an upwardly extending striker 315 which is able to strike a lower surface of modified cam 207. The member 343 also has a forwardly extending arm 316 with an upward forward extension 317. The member 343 carries a pair of rollers 318 on forward extension 316 as seen in FIG. 29 so that any forward, rearward tilting or rotational movement of the retention member 5 will cause the rollers 318 to move on a surface 311 or 312 thereby turning the member 343 anticlockwise in FIG. 28 and causing the striker 315 to strike the cam 207 thus effectively releasing the heel lock. The member 343 also has an upward extension 319 with which release member 35 is pivotally attached at 320 to the upward extension 319 so that an anticlockwise rotation of the member 343 will also cause the latches 14 to be released substantially as previous described. Member 343 and release member 35 act in unison to form combined biased release and retention member 35.

The spigot 309 extends downwardly between the bifurcated parts of the forward extension 316 and provides a tapered part 321 which is held by similarly tapered socket 322 extending upwardly from the bottom of bearing member 5 to allow bearing member 5 to turn. The forward extension 316 preferably also mounts a further roller 324 which rests against the underside of the block 310 to provide better stability to the construction but this integer may be deleted if desired.

In the constructions of FIGS. 30 and 31, the latch 14 is mounted to the bearing member 5 through a pivot pin 330. Pivotally connected between the latches 14 is a transverse member 331 and which mounts a roller 332 at each end thereof, for example, by means of a pivot pin 333 passing between bifurcated arms of the member 331.

The transverse member 331 may be pivotally mounted to the bearing member 5 by means of a pivot pin 334 and the length of member 331 is such that with the transverse member 331 positioned in the position shown in FIG. 28, so that the latches 14 and heel clamp 200 are held in engagement with a ski boot during use. A tension spring 335 may be provided to assist in maintaining this position for the transverse member 331. By reference to FIG. 30 movement of the transverse member 331 beyond a predetermined position in a clockwise direction is prevented by stop or block 336 but movement in the anticlockwise direction may be achieved as follows.

The rear face 337 of the transverse member 331 is formed to a curved shape but terminating at stop 338. Pivot pin 339 mounts a forwardly extending arm 340 which terminates in roller 341 which is normally positioned against stop 338. The arm 340 extends beyond the pivot 339 to provide a part 342 which may be struck by the probe 47 to cause rotation of the arm 340 in, by reference to FIG. 30, a clockwise direction. That is to say roller 341 will move along curve 337 forcing the transverse member 331 to rotate in an anticlockwise direction, (by reference to FIG. 30) thereby allowing latches 14 to move to free themselves from a ski boot.

FIG. 32 shows a construction wherein stressing of the ski may be achieved in a manner substantially similar to that in FIG. 18 except that the arm 175 does not directly connect to the pin 174 in slot 173. Rather the arm 175 engages a bell crank 350 which is pivotally attached to intermediate member 6 and co-joins the arm 175 and the pin 174.

In the construction of FIG. 33 the arm 175 terminates in a block 172 having a slot 173. A bell crank 351 is provided pivotally attached to the intermediate member 6 by a pivot at 352. The bell crank 351 which may be in the form of a double bell crank or a bifurcated bell crank mounts a pin or roller 353 which slides in the slot 173 in block 172 so that a rearward movement of the arm 175 and block 172 will cause the bell crank 351 to rotate in an anticlockwise direction thereby stressing the ski.

In the construction of FIG. 34 the side latches 14 are replaced by a latch 360 transverse of the ski 1. This latch 360 engages a suitably shaped part of the heel 3 such as forwardly extending protuberance 361. The latch 360 is pivotally mounted to retention member 5 by pivot pin 362. A catch 360 may be replaced by a suitable abutment and the boot securing means completed by the heel catch 120. This figure also shows the bearing member 5 biased to its rest position by a flexible cable 363 engaged at its forward end to bearing member 5. The cable passes through bearing 364 and is biased by spring 365 between bearing 364 and end plate 366 mounted on cable 363.

These mountings can be reversed. In FIG. 35 the pins 51 are replaced by cam 370 which may be mounted on spigot 9. The cam 370 strikes parts 371 on combination plate 35 as retention member 5 rotates, thereby acting in the same manner as pins 51 in FIGS. 4 and 5

In FIG. 36 two side latches 380 are provided one each side of boot 2. These may be placed at almost any position along the substantially stiff instep and heel portion of the otherwise flexible ski boot sole length of the boot. Latches 380 operate as for latches 14 but allow the heel clamp to be removed.

In construction of FIG. 37 a covered flexible cable is releasably attached to boot 2, in particular to lever connection 181. The inner cable passes through a guide plate 391 which defines the movement, together with member 392, of the outercable covering. Member 392 is a variation of part of intermediate member 6 upstanding from the ski 1 and again acts as a stress member. The cable 390 engages the ski at some suitable distance by a known cable attachment means, not herein described, stress is applied to the ski in the following manner. Lever 85 and consequently lever 181, which is a further variation of previous examples is moved forwardly by forward movement of a skiers leg, thereby moving cable 390 inside its flexible sheath. The cable and sheath covering between the boot plate 391 and the intermediate member 6 remaining flexible while transmitting the necessary energy to stress the ski 1. Upon accidental release of the boot 2 from the binding this flexible connection may act in the same manner as did the leash safety system prior to the introduction of modern ski brakes, to save and guard against "runaway" skis. A quick release cable connector, well known to industry and not described here, may be interspersed at a convenient point between the boot and the upstand member 393, or intermediate member 6 for use as and when may be required. The cable 390 and environs between upstanding member 393 and cable fixing member 394 may be protected by some suitable flexible material such as rubber of suitable proportions so as to protect the cable and to guard against any possible entanglements such as with other skiers or another ski.

FIG. 38 shows a construction in which the cable construction of FIG. 37 is used by in which the member 392 is replaced by a ski stressing mechanism substantially as shown, for example, in FIG. 20.

FIGS. 39 and 40 are substantially as shown in FIGS. 26 and 27 except that the cheek plates 286 have been deleted and the pedestal 400 has been widened to form a tapered block confined between the edges of the release member 35. A pair of rollers 287 and a pair of rollers 288 are provided. Anti-friction devices can be positioned between the ends 401 of the tapered block 400 and the side walls 402 of the release member 35. The faces 284 and 285 extend downwardly at a mutually inwardly angle i.e. having no vertical parts. This makes the difference between holding and forcing bearing member 5 on to intermediate member 6.

The use of the invention is as follows:

In use the latches 14 are initially locked in position and the boot 2 is positioned on the binding so that protrusion 12 engage their respective latches 14 and so that downward heel pressure closes the rear heel clamp 19, 120 or 200.

During use in the constructions of FIGS. 3 and 11, forward movement of the leg will cause the bottom end of the levers to be rotated backwardly thereby movin rearwardly the bifurcated slide 81 and causing flexing of the ski as above described.

Should abnormal rotations of the bearing member 5 occur, pins 51 will move the release member 35 forwardly causing the probe 47 to strike the arm 48 on cam 28. This will allow the cams to move to the positions shown in FIG. 5, whereupon the protrusion 27 will become removed from the notch 24 and the tongue 21 can move inwardly thereby allowing the latches 14 to be moved outwardly releasing the ski boot. No independent resistance against member 5 rotating results from bifurcated member 81 because of its situation in a arcuate slot.

The principle purpose of the heel clamp is resist upward movement of the heel but as twisting release of the boot is by virtue of the side catches the pressure setting of the heel clamp does not affect the releasing by the side catches. The heel clamps could be replaced in FIGS. 21, 22, 23, 26, 27, 28, 29 or in any combination thereof wherein the bearing member 5 was able to move in two or more planes by extra side catches operating and set forth herein for the side clamps 14. The constructions of the remaining figures are used in substantially the same manner and as described hereinbefore but as can be seen many parts and their functions can be interchanged as suitably required. The direction of movement in use of the release member 35 is substantially normal to the axis or axes of movement of bearing member 5. The release movements between the bearing member 5 and the ski which are operationally useful in the sense that they release the ski boot from the binding are limited to one or more of lateral twisting, upward, or upward twisting by the construction of the binding.

Referring to FIG. 41 a ski, a skiboot, a skiboot lever member and a skiboot binding combination is provided as follows: A ski 1 is provided with a lever platform member 420. Substantially horizontal pin members 421 and 422 for mounting lever platform member 420 to the ski 1 are provided. Skiboot binding mechanisms 423 and 424 are provided for releasably attaching skiboot 425 to lever member 420. Platform lever member 2 preferably consists in a substantially rigid but light weight construction of sufficient length to give sufficient leverage to the ski, and to accommodate a suitable skiboot and binding mechanism as its substantially flat upper surface The lever platform member has a lower surface comprising two different geometric planes so that one end, preferably the rearwardly one is parallel to the upper surface of the said member. The other plane 426 slopes forwardly upwards so that the forward end of the said member is of a lesser depth than the rearward end of said member. The sides of the said member can be substantially parallel to each other. The said platform lever member 420 is attached substantially rigidly at it rearward end by intermediate pin members 421 and 422 which are fixed by some convenient means to the ski 1.

Or the lever platform member 420 can be fixed directly to the ski 1 by any such means that may be convenient. Such attachment of the lever platform member 420 to the ski 1 allows the forward end of the said lever platform member to be maintained in a free unattached relationship with the ski 1. The upwardly sloping undersurface 426 of the lever platform member 420 can be commenced at any suitable point of the lower surface to the lever patform member 2.

The use of the construction of FIG. 41 is as follows. In use, the skiboot 1 is placed on to the upper surface of the platform lever member 420 and releasably clamped thereto by the skiboot binding members 423 and 424. During use the skier leans forwardly thereby transferring his weight from the rear and supported end of the lever platform member 420 to the forward and unsupported end of the said member. The transferrance of sufficient weight forwardly will have the effect of lifting the rearward portion of the ski from the snow. Thus it can readily be seen that a skiboot, a platform lever member such as described herein, a skiboot binding and a ski in combination has the ability to supply to the skier an improved means of applying stress to the ski, while still allowing safe ski boot binding retention pressures.

Thus it can be seen that at least in the preferred form of the invention a ski binding is provided which has the advantage that the ski boot does not unduly fatigue the skier as the sole can be flexible and the cuff substantially freely pivotable, and does not unnecessarily restrict foot and ankle flexation for walking purposes nor impede blood circulation. The ski boot does however supply ankle support while skiing. The ski boot binding mechanism provides effective transfer of the skier's energy to the ski whilst minimising dissipation into the ski boot binding and also allows a substantial reduction of the boot holding forces required of the binding thereby increasing skier safety.

It is a particular advantage of the present invention that the release and retention pressure is to at least some degree independent of the ski operating pressure.

In prior art constructions the ankle is substantially locked and the leg is forced against the locked system.

In the present invention however the movement of the leg is through the unlocked mechanism and is caused by leg movement against a lever to bend or stress the ski.

What I claim is:

1. A ski stressing means comprising a ski-boot, at least one lever mounted on said ski-boot and tensioning means between said at least one lever and said ski, said tensioning means comprising a tensioning member, a connection means between said ski and said tensioning member, said connection means comprising a slide member having a slot therein, a pin movable in said slot and attached to said ski, said slot being disposed relative to said ski so that movement of said pin in said slot can cause selectively an increase and decrease in distance between said ski and said slide member.

2. Ski stressing means as claimed in claim 1 wherein said connecting member engages a bell crank and said bell crank engages a bracket on said ski, movement of said connecting member rotating said bell crank to tension said ski in use.

3. A ski stressing means comprising a ski boot at least one or more lever mounted on said ski boot, tensioning means between said at least one lever and said ski.

4. Ski stressing means as claimed in claim 3 wherein said tensioning means comprises at least one lever pivotally connected to said ski boot, a guide on said intermediate member and a cable between said ski and at least one said lever, said cable passing through said guide.

5. Ski stressing means as claimed in claim 1, wherein said ski includes a less rigid region between the point of attachment of said intermediate member and said connection means.

6. A ski-binding comprising: a ski boot bearing member; at least one ski boot confinement means mounted on and movable relative to said bearing member; and elastic attachment means for elastically attaching said bearing member to a ski for elastic movement relative thereto, said elastic attachment means including at least one control means selectively mounted to one of said ski and a substantially rigid member associated with said ski, and which acts upon at least one associated control means for releasing said confinement means from a confining attitude with regard to said boot upon movement of said bearing member relative to said ski; said at least one control means also acting upon said at least one associated control means to control the disposition of said bearing member relative to said ski; and wherein the ski boot confinement means release activating movements of said bearing member relative to said ski include at least one movement including at least one of forward, back, lateral twisting, upward twisting, and upward movements; said at least one associate control means acting upon said confinement means only after a predetermined relative movement of said bearing member relative to said ski, said at one associate control means and said bearing member having apertures therein, and selectively one of said ski and member associated with said ski mounting at least one post extending through said apertures so that upon movement of said bearing member relative to said ski said at least one post engages said at least one associate control means about said aperture therein to move said at least one associate control means relative to said bearing member.

7. A ski-binding comprising: a ski boot bearing member; at least one ski boot confinement means mounted on and movable relative to said bearing member; and elastic attachment means for elastically attaching said bearing member to a ski for elastic movement relative thereto, said elastic attachment means including at least one control means selectively mounted to at least one of said ski and a substantially rigid member associated with said ski, and which acts upon at least one associate control means for releasing said confinement means from a confining attitude with regard to said ski boot upon movement of said bearing member relative to said ski; and at least one control means also acting upon said at least one associate control means to control the disposition of said bearing member relative to said ski; and wherein said ski boot confinement means release activating movements of said bearing member relative to said ski include at least one movement including at least one of forward, back, lateral-twisting, upward twisting and upward movement; said at least one associate control means acting upon said confinement means only after a predetermined relative movement of said bearing member relative to said ski, said at least one associate control means having receiving means, and selectively one of said ski and member associated with said ski mounting at least one member operatively about said receiving means so that upon movement of said bearing member relative to said ski at least one member engages said at least one associate control means about said receiving means to move said at least one associate control means relative to said bearing member.

8. A ski-binding comprising a ski-boot bearing member, at least one confinement means movable relative to said bearing member for releasably confining a ski-boot in use to said bearing member, elastic attachment means for elastically attaching said bearing member to a ski for elastic movement relative thereto, said elastic attachment means including at least one control means, which acts upon an associate control means for releasing said confinement means from said confining attitude with regards to said ski-boot and which are controlled by a predetermined relative movement of said bearing member relative to said ski, wherein ski-boot confinement means release activating movements of said bearing member relative to said ski including at least one movement including at least one of forward, back, lateral twisting and upward movement so that upon movement of said bearing member relative to said ski beyond said predetermined limit said at least one control means causes said associate control means to release said confinement means, said control means also maintaining the disposition of said bearing member relative to said ski until sufficient force to overcome said control means displaces said bearing member relative to said ski, said control means and said bearing member having apertures therein, and selectively one of said ski and a member associated with said ski mounting at least one post extending through said apertures so that upon movement of said bearing member relative to said ski said at least one post engages asaid control means about the aperture therein to move said control means relative to said bearing member.

9. A ski binding comprising a ski boot bearing member, at least one confinement means movable relative to said bearing member for releasably confining a ski boot in use to said bearing member, elastic attachment means for elastically attaching said bearing member to a ski for elastic movement relative thereto, said elastic attachment means including at least one control means which acts upon an associate control means for releasing said confinement means from said confining attitude with regard to said ski boot and which are controlled by a predetermined relative movement of said bearing member relative to said ski wherein ski boot confinement means release activating movements of said bearing member relative to said ski include at least one movement including at least one of forward, back, lateral twisting and upward movement so that upon movement of said bearing member relative to said ski beyond said predetermined limit said at least one control means cause said associate control means to release said confinement means, said control means also maintaining the disposition of said bearing member relative to said ski until sufficient force to overcome said control means displaces said bearing member relative to said ski, said at least one control means having receiving means, and selectively one of said ski and a member associated with said ski mounting at least one member operatively about sad receiving means so that upon movement of said bearing member relative to said ski said at least one member engages said control means about said receiving means to move said control means relative to said bearing member.

10. A ski binding comprising a ski boot bearing member, at least one confinement means movable relative to said bearing member for releasably confining a ski boot in use to said bearing member, elastic attachment means for elastically attaching said bearing member to a ski for elastic movement relative thereto with at least part of the lower surface of said bearing member being in direct contact with said ski or a substantially rigid member associated therewith so that no downward movement of a substantial part of said bearing member relative to said ski from the rest position of said bearing member can occur, said elastic attachment means including at least one control means, which acts upon an associate control means for releasing said confinement means from said confining attitude with regard to said ski-boot and which are controlled by a predetermined relative movement of said bearing member relative to said ski, wherein ski-boot confinement means release activating movements of said bearing member relative to said ski include at least one movement including at least one of forward, back, lateral twisting and upward movement so that upon movement of said bearing member relative to said ski beyond said predetermined limit said at least one control means causes said associate control means to release said confinement means, said control means also maintaining the disposition of said bearing member relative to said ski until sufficient force to overcome said control means displaces said bearing member relative to said ski, said at least one control means having receiving means, and selectively one of said ski and a member associated with said ski mounting at least one member operatively about said receiving means so that upon movement of said bearing member relative to said ski said at least one member engages said control means about said receiving means to move said control means relative to said bearing member.

11. A ski binding as claimed in claim 9 wherein said elastic attachment means urge said bearing member towards a binding mounting surface of said ski and into contact selectively with one of said ski and an associated member mounted on said ski for relative elastic movement therewith.

12. A ski-binding as claimed in claim 9 wherein said elastic attachment means urge said bearing members towards a binding mounting surface of said ski into a forced contact with said ski or member mounted on said ski for all relative elastic movement therewith.

13. A ski-binding as claimed in claim 9 wherein elastic movement of said bearing member relative to said ski is translated to movement of said elastic attachment means in less than two planes.

14. A ski-binding as claimed in claim 9 wherein elastic movement of said bearing member relative to said ski is translated to movement of said elastic attachment means and is restricted to a single elastic movement of said elastic attachment means.

15. A ski-binding as claimed in claim 7 wherein at least one locking cam is provided between said confinement means and said release member so that upon movment of said release member beyond a predetermined position relative to said bearing member, said release member strikes said at least one cam to release said confinement means.

16. A ski binding as claimed in claim 9 wherein said confinement means are positioned in use one each side of a said ski-boot.

17. A ski binding as claimed in claim 16 wherein a further said confinement means is positioned behind the heel of said ski-boot.

18. A ski binding as claimed in claim 9 wherein said confinement means are positioned one at the front of and one at the rear of said heel of said ski-boot in use.

19. A ski binding as claimed in claim 15, wherein said release member and said bearing member have apertures therein selectively, one of and said ski and a member associated therewith mounts at least one post extending through said apertures so that upon movement of said bearing member relative to said ski at least one of said at least one post and any part thereof engages said release member about the aperture therein to move said release member about the aperture therein to move said release member relative to said bearing member.

20. A ski binding as claimed in claim 15 wherein said at least one locking cam comprises at least one pins.

21. A ski binding as claimed in claim 15 wherein said control means includes at least one pedestal having downwardly converging opposite faces, said at least one associate control member mounting a contact means bearing on one said face of said at least one pedestal and said bearing member mounting a contact member bearing on the other said face of said at least one pedestal.

22. A ski binding as claimed in claim 21 wherein said contact members each comprise rollers.

23. A ski binding as claimed claim 9 wherein said bearing member is connected to an intermediate member through a double pivot connector having the axes of rotation substantially at right angles at least one to the other.

24. A ski binding as claimed in claim 23 wherein said connector is connected to said bearing member by at least one pivotal links.

25. A ski binding as claimed in claim 15 wherein said locking cams are provided in pairs, each pivotally mounted to said bearing memeber, one said cam engaging a notch in said confinement means and having a notch into which a protrusion on the other said cams engages to substantially prevent rotation of the first said cam, striking of said second cam by said release member allowing said second cam to move from said notch in said first cam and allowing said first cam to move from said notch in said confinement means.

26. A ski binding as claimed in claim 25 wherein said confinment means includes a tongue, said notch in said confinement means being provided in said tongue.

27. A ski binding as claimed in claim 9 and a ski boot wherein said binding member is associated with an intermediate member, said intermediate member carrying tensioning means to stress said ski in use.

28. A ski binding as claimed in claim 27 wherein said tensioning means comprises at least one lever means pivotally connected to said ski boot, an intermediate member mounting at least one union engaged by said at least one lever means and moveable relative to said boot, and a connection means between said at least one union and said ski operable by said union to selectively increase and decrease the distance between parts of said intermediate member and the adjacent parts of said ski.

29. A ski binding as claimed in claim 24 wherein said connection means comprises a member having a slot therein, a pin movable in said slot and attached to said ski member, said slot being disposed relative to said ski so that movement of said pin in said slot in one direction and both can cause said decrease in distance between said ski and said intermediate number.

30. A ski binding as claimed in claim 29 wherein said ski is less rigid between the point of attachment of said intermediate member and said connection means.

31. A ski binding as claimed in claim 28 wherein said connection means engages a bell crank and said bell crank engages a bracket on said ski, movement of said connection means rotating said bell crank to tension said ski in use.

32. A ski binding as claimed in claim 27 wherein said tensioning means comprises a lever means pivotally connected to said ski boot, a guide on said intermediate member and a cable between said ski and at least one said lever means, said cable passing through said guide.

33. A ski binding as claimed in claim 15 wherein said control means has a rearward extension which bears in use against a surface shaped so that as said bearing member moves said release member is moved relative to said bearing member by engagement of sid extension with said surface.

34. A ski binding as claimed in claim 9 further including a heel clamp provided between said retention member and said ski boot.

35. A ski-binding as claimed in claim 34 wherein said heel clamps comprise a pivotal member from which extends a projecting lip to clamp a ski-boot heel, biasing means to bias said pivoted member so that said pivotal lip is in a clamping disposition, and manually operable means to override said biasing means to allow said pivotal member to rotate to a position wherein said biasing means maintains said pivotal member in a position wherein said projecting lip is in a non-clamping disposition until said biasing means are again over-ridden.

36. A ski-binding as claimed in claim 35 wherein said biasing means includes a biasing member carrying a contact member and said pivotal member carries a pin bearing against a face of said contact member, said face of said contact member being sloped rearwardly over parts of its area so that with said pivotal member rotated so that said projecting lip is in a non clamping disposition said pin is positioned against said sloped part of said face, so that rotation of said pivotal member to move said projectng lip ihto its clamping position is resisted by contact between said pin and said face until sufficient force is applied to said pivotal member to force said pin away from said sloped part of said face.

37. A ski-binding as claimed in claim 9 wherein said activating means delay activation of said associate confinement means for a predetermined period, said predetermined period being selected during construction of said ski-binding.

38. A ski-binding as claimed in claim 16 wherein said confining means are positioned rearward of the ball of the user's foot in use.

39. A ski-binding as claimed in claim 28 wherein said connection means comprise a slide member having a pin mounted therein, and a member having a slot therein attached to said ski member, said slide member being movable so that said pin moves in said slot, said slot being disposed relative to said ski so that movements of said pin in said slot can cause said selective increase and decrease in distance between said ski and said intermediate member.

40. A ski-binding as claimed in claim 28 wherein said connecting means comprises a bell crank, said bell crank engaging a bracket on said ski, movement of said bell crank tensioning said ski in use.

41. A ski-binding as claimed in claim 9, wherein at least one locking cam is provided between said confining means and said control means so that upon movement of said control means beyond a predetermined position relative to said bearing member, said control means strikes said at least one cam to release said confining means.

* * * * *